US009664483B2

(12) United States Patent
Crowe et al.

(10) Patent No.: US 9,664,483 B2
(45) Date of Patent: May 30, 2017

(54) BULLET TRAP

(71) Applicants: Kenneth Dale Crowe, Gladstone, ND (US); Edward Fransen, Irvine, CA (US)

(72) Inventors: Kenneth Dale Crowe, Gladstone, ND (US); Edward Fransen, Irvine, CA (US)

( * ) Notice: Subject to any disclaimer, the term of this patent is extended or adjusted under 35 U.S.C. 154(b) by 0 days.

(21) Appl. No.: 14/941,532

(22) Filed: Nov. 13, 2015

(65) Prior Publication Data

US 2016/0187108 A1 Jun. 30, 2016

Related U.S. Application Data

(60) Provisional application No. 62/079,520, filed on Nov. 13, 2014.

(51) Int. Cl.
*F41J 13/00* (2009.01)

(52) U.S. Cl.
CPC ..... *F41J 13/00* (2013.01)

(58) Field of Classification Search
CPC ..... F41J 13/00; F41J 13/02
USPC ..... 273/404, 410
See application file for complete search history.

(56) References Cited

U.S. PATENT DOCUMENTS

| | | | | |
|---|---|---|---|---|
| 3,737,165 | A * | 6/1973 | Pencyla | F41J 13/00 273/410 |
| 5,400,692 | A * | 3/1995 | Bateman | F41J 13/00 273/410 |
| 5,456,155 | A * | 10/1995 | Myrtoglou | F41J 13/00 273/410 |
| 6,715,761 | B1 * | 4/2004 | Moberg | F41J 13/00 273/410 |
| 8,602,418 | B1 * | 12/2013 | Hering | F41J 13/00 273/410 |
| 2006/0208425 | A1 * | 9/2006 | Lambert | B23K 11/0053 273/410 |
| 2012/0181752 | A1 * | 7/2012 | Bavaro | F41J 13/00 273/410 |

* cited by examiner

*Primary Examiner* — Mark Graham
(74) *Attorney, Agent, or Firm* — Roy A. Ekstrand

(57) ABSTRACT

A plate-type bullet trap provides an adjustable angle upper and lower plate system which facilitates adjustment of the individual angles of each plate as well as the mutual and relative angles between the plates. In this manner, the geometry presented by the plate-type bullet trap system may be varied to present a maximized efficiency and effectiveness of the plate trap geometry for various entrance paths and characteristics for bullets and other projectiles.

7 Claims, 7 Drawing Sheets

BULLET TRAP

CROSS-REFERENCE TO RELATED APPLICATION

This application claims the benefit of and priority under 35 U.S.C. 119(e) of U.S. Provisional Patent Application No. 62/079,520 entitled BULLET TRAP, filed Nov. 13, 2014 in the name of Kenneth Dale Crowe and Edward Fransen, the disclosure of which is incorporated herein by reference.

FIELD OF THE INVENTION

This invention relates generally to bullet trap systems and particularly to improvements in the deployment and application thereof.

BACKGROUND OF THE INVENTION

Bullet trap systems, or devices that are used to catch projectiles have been used for many years by law enforcement, military and the general public to collect fired ammunitions in a contained environment. The primary objective of these devices have been to provide a means and method for the redirection, collection, and containment of spent bullets in a manner that is ideally safe and to protect the shooters from ricochets, splashback of fragments, and hazardous dust. Ideally the bullet trap devices should capture the intended caliber of ammunition and accommodate the composition, velocity and energy of the incoming projectiles while preventing potentially dangerous subsequent conditions for the users of the device that arise from shooting bullets. Existing bullet trap systems have evolved from simple dirt or sand berms to metal plate configurations, water traps and media trap designs that involve granulated rubber media.

Metal plate type bullet traps have been provided in varying shapes, sizes and configurations. However, all generally provide an upper plate set and a lower plate set which are typically planar and linear in fabrication. The upper plate is typically suspended from the ceiling portion of the host facility and is angled downwardly in the direction of anticipated bullet travel. Conversely, the lower plate is typically supported upon the ground by a support structure and is angled upwardly in the direction of anticipated bullet travel. Thus, the upper and lower plates converge to provide an ever narrowing bullet path directed toward a bullet deceleration chamber. The typical bullet deceleration chamber defines an entrance opening and a generally closed chamber sufficient in length to captivate and retain a partially spent bullet that has traveled to the deceleration chamber through the tapered plate array. The bullet typically dissipates the remaining energy that it possesses within the bullet deceleration chamber and, once fully dissipated, drops into a bullet containment center typically housed beneath the deceleration chamber. Thus a bullet or other projectile entering the bullet trap initially impacts the upper or lower plate of the bullet trap and then ricochets toward the oppositely positioned plate and further ricochets back to the previous direction in a pattern of plate to plate ricochets converging to enter the deceleration chamber. As the bullet or other projectile experiences successive ricochets back and forth between the upper and lower plate of the bullet trap, portions of the bullet energy are absorbed and expended as the bullet works its way toward the deceleration chamber. The extent to which the bullet trap effectively and efficiently dissipates the energy of an incoming bullet is to a large extent determined by geometric relationships between the path of the incoming bullet and the angles of the upper and lower plates. Accordingly, practitioners in the art have expended substantial effort in endeavoring to properly design plate-type bullet traps to fix the plate angles for best operation.

While conventional plate-type bullet traps have to some extent improved the art and have in some instances enjoyed commercial success, there remains nonetheless a continuing and unresolved need in the art for evermore improved, effective, efficient and safe plate-type bullet traps.

SUMMARY OF THE INVENTION

Accordingly, it is a general object of the present invention to provide an improved metal plate-type bullet trap system. It is a more particular object of the present invention to provide an improved metal plate-type bullet trap system in which the geometry of the bullet trap may be adjusted to maximize efficiency, safety and effectiveness of the bullet trap.

Accordingly, the present invention bullet trap provides an upper plate system which is generally planar and which is suspended from the host facility ceiling by a plurality of adjustable supports. The upper plate is angled downwardly toward a deceleration chamber supported beneath the ceiling. The invention further includes a lower plate system which is generally planar and which extends upwardly from the facility foundation surface toward the deceleration chamber. In accordance with the invention, the supporting structure provided for the lower plate system is adjustable to provide an adjustable angle for the lower plate system. In this manner, the relative angles between the upper and lower plate systems may be adjusted to maximize efficiency and effectiveness of the present invention plate-type bullet trap. The inventive system further utilizes a bullet deceleration chamber which receives the incoming bullets traveling between the bullet trap plates. The deceleration chamber may be of conventional design utilizing virtually any of the presently available conventional deceleration chambers. The ability to adjust the angles of the upper plate system and lower plate system independently facilitates the creation of a variety of different geometries all directed toward maximizing the effectiveness, efficiency and safety of the inventive system.

Thus, in summary, the present invention provides a bullet trap for use in a target range within which a plurality of projectiles or bullets are fired or directed one or more targets comprising: an upper plate having a projectile and bullet impervious plate supported above the projectile or bullet line of flight and angled downwardly toward a bullet receiving area; a lower plate supported beneath said upper plate and having a projectile and bullet impervious face, said lower plate being supported in an upwardly angled orientation generally converging toward said bullet receiving area; and a projectile and bullet collecting apparatus including a deceleration chamber positioned to receive projectiles or bullets passing into said bullet receiving area, said upper and lower plates being adjustably positioned to provide an optimized geometry for projectile or bullet collection.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

By way of overview, the present invention plate-type bullet trap provides an adjustable angle upper and lower plate system which facilitates adjustment of the individual angles of each plate as well as the mutual and relative angles between the plates. In this manner, the geometry presented by the plate-type bullet trap system of the present invention may be varied to present a maximized efficiency and effectiveness of the plate trap geometry for various bullets and other projectile entrance paths and characteristics. It will be noted that the terms "bullet" and "bullet trap" are inclusive of terms such as "projectile" or "projectiles or projectile traps" herein and that the invention is often referred to generically as a "bullet trap" which will be understood to include "projectile traps" and so on.

Figure 1:
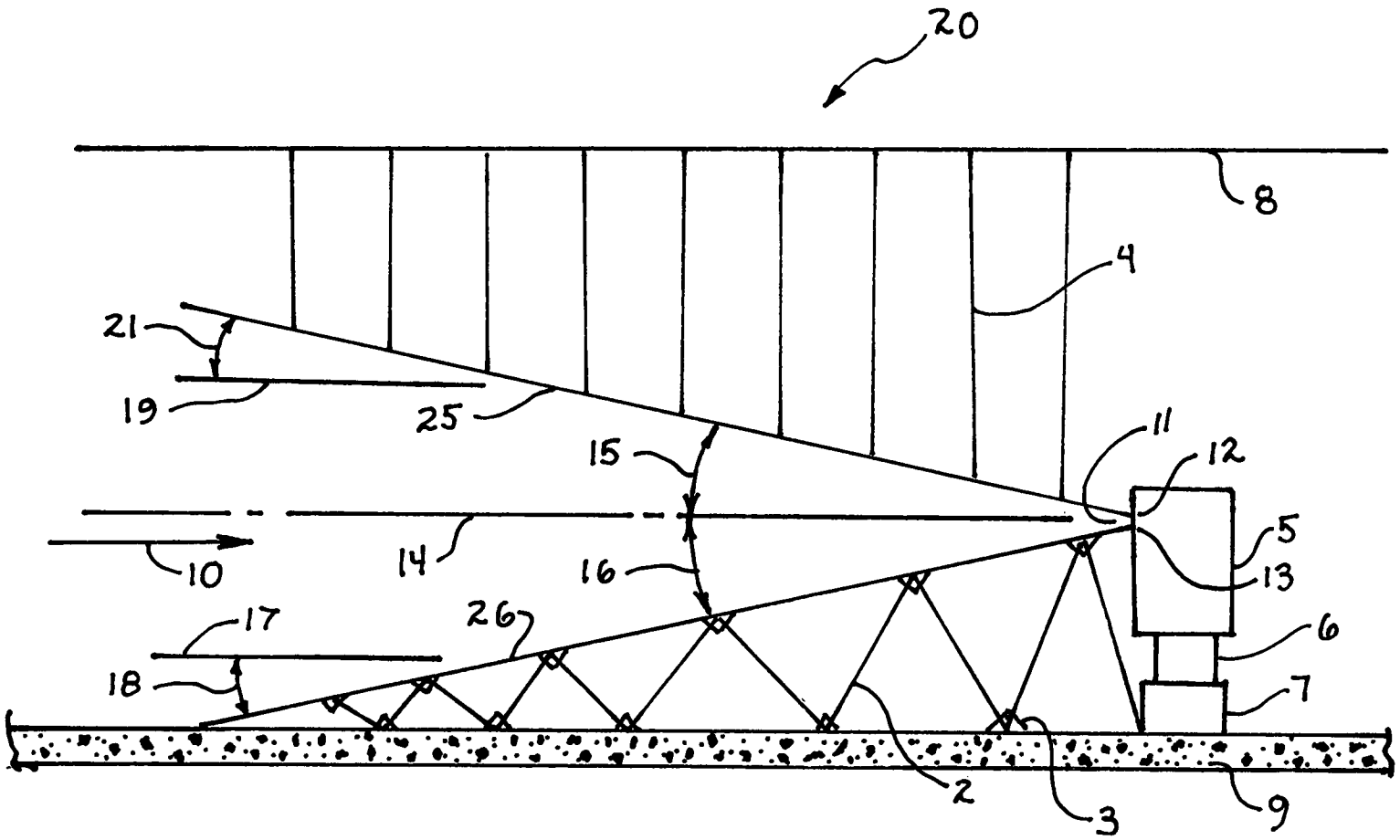
FIG. 1 sets forth a side elevation view of a plate-type bullet trap constructed in accordance with the present invention.

More specifically, FIG. 1 sets forth a side elevation view of a plate-type bullet trap constructed in accordance with the present invention and generally referenced by numeral 20. Bullet trap 20 is situated within a host facility having a generally flat foundation 9 and an upper ceiling structure 8. Foundation 9 may, for example, be a conventional flat concrete floor while ceiling 8 may comprise virtually any conveniently available supported ceiling structure. Thus, bullet trap 20 is positioned upon foundation 9 beneath ceiling 8 as shown in FIG. 1. Bullet trap 20 includes an upper plate 25 suspended from ceiling 8 by a plurality of adjustable upper support structures 4. Conversely, lower plate 26 rests upon a support structure formed by a plurality of support trusses 2 which in turn utilize a plurality of truss hinges 3 to form a support structure for lower plate 26. Truss hinges 3 may be of conventional design with the important property of permitting movement of the coupled trusses with respect to foundation 9 and lower plate 26. It will be apparent to those skilled in the art that upper plate 25 and lower plate 26 may be formed of a plurality of connected plate segments without departing from the spirit and scope of the present invention.

Bullet trap 20 further includes a deceleration chamber 5 constructed of conventional fabrication techniques and defining a bullet inlet aperture 11. A hinge 12 is situated above inlet 11 and couples the interior end of upper plate 25 to deceleration chamber 5. Similarly, a lower hinge 13 couples the interior end of lower plate 26 to deceleration chamber 5 beneath inlet 11. In further accordance with conventional fabrication techniques, a bullet containment center 6 is situated beneath bullet deceleration chamber 5 to receive spent bullets for containment. Containment center 6 is supported upon foundation 9 by a containment support 7 also of conventional fabrication techniques.

In accordance with the present invention, upper plate 25 is seen to form an angle 15 with respect to a center line 14 dividing the angled space between upper plate 25 and lower plate 26. Similarly, lower plate 26 is seen to define an angle 16 relative to center line 14. In addition, it will be apparent that upper plate 25 also defines an angle 21 relative to a horizontal reference 19. Similarly, it will be seen that lower plate 26 defines an angle 18 relative to a horizontal reference 17. In the anticipated use of the present invention bullet trap, incoming bullets or other projectiles travel in the direction generally indicated by arrow 10.

In operation, it will be understood that the length of adjustable upper supports 4 may be altered to change the angle of upper plate 25 both with respect to center line 14 and horizontal reference 19. Similarly and in accordance with an important aspect of the present invention, it will be apparent that the relative relationships between support trusses 2 and foundation 9 and lower plate 26 may be adjusted to alter relative angles 16 and 18 with respect to center line 14 and horizontal reference 17 respectively. In accordance with an important aspect of the present invention, this adjustment of upper support structures 4 and support trusses 2 facilitates the optimizing of the geometry presented by bullet trap 20. In this manner, the angle presented by the combined structure of upper plate 25 and lower plate 26 relative to horizontal references 19 and 17 respectively may be changed. Additionally, the relative angles between upper plate 25 and lower plate 26 with respect to center line 14 may be further adjusted. As a result, the entire geometry of the resulting plate structure is capable of precise geometric alignment to maximize trap efficiencies for various types of bullets and projectiles.

Figure 2:
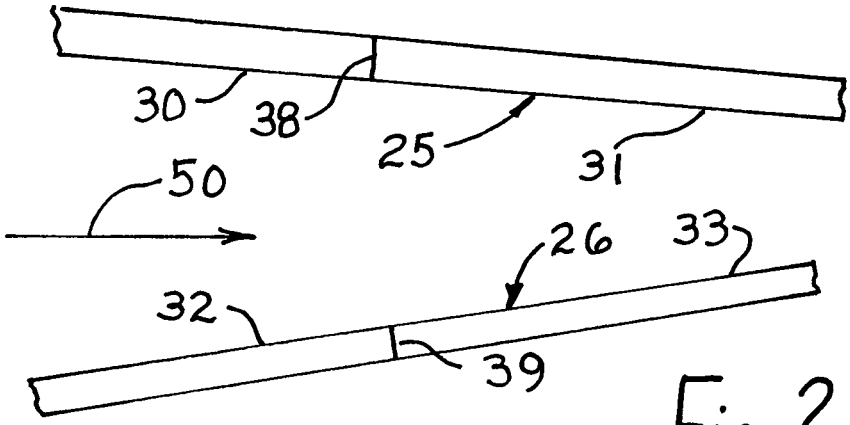
FIG. 2 sets forth a partial side view of the upper and lower plates of the present invention.

FIG. 2 sets forth a partial side view showing a typical construction for upper plate 25 and lower plate 26. Upper plate 25 is formed of a plurality of plate segments such as 30 and 31. Similarly, lower plate 26 is formed of a plurality of plate segments such as plate segments 32 and 33. Plate segments 30 and 31 are joined at a butt joint 38 which comprises a welded joint therebetween. Similarly, plate segments 32 and 33 are joined at a butt joint 39 which also comprises a welded joint. The fabrication shown in FIG. 2 is preferred in the fabrication of upper plate 25 and lower plate 26 due to the smooth contour provided by weld joints 38 and 39. Thus, in fabricating upper plate 25 and lower plate 26 to provide the expanse of steel plate segments, a plurality of plate segments are joined in butt joints which are secured by welding. The result is a smooth flat contour free of any discontinuities. The preferred fabrication of the present invention bullet trap utilizes upper and lower plates each fabricated from a plurality of plate segments. The preferred material for the plate segments of the present invention bullet trap is, for most installations, high strength steel. However, it will be apparent to those skilled in the art that other high strength materials may be utilized without departing from the spirit and scope of the present invention. For purposes of illustration, FIG. 2 shows upper plate 25 and lower plate 26 angled toward each other to converge in the direction of bullet or projectile path as indicated by arrow 50.

Figure 3:
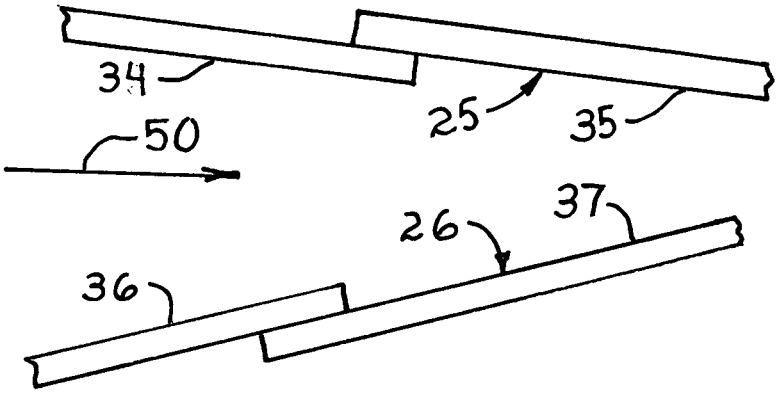
FIG. 3 sets forth a partial side view of the upper and lower plates of an alternate embodiment of the present invention.

FIG. 3 sets forth a partial view of an alternate fabrication of the present invention upper and lower plates. In the embodiment shown in FIG. 3, upper plate 25 is formed of a plurality of plate segments such as segments 34 and 35 which are joined in an overlapping fashion. Similarly, lower plate 26 is shown formed of overlapping plate segments 36 and 37. In the preferred fabrication of the embodiment of the invention shown in FIG. 3, a welded junction is still utilized as plate segments overlap. Of importance to note in the embodiment shown in FIG. 3 is the direction of overlap of plate segments. With the travel of projectiles or bullets in the direction indicated by arrow 50, it is important that each plate segment overlap the succeeding segment such that an exposed edge is not presented to projectiles or bullets traveling in the direction indicated by arrow 50. The avoidance of exposed edges in the direction of projectile or bullet travel is necessary to avoid the undesired effects of fragmentation as projectiles or bullets encounter an exposed edge.

Figure 4:
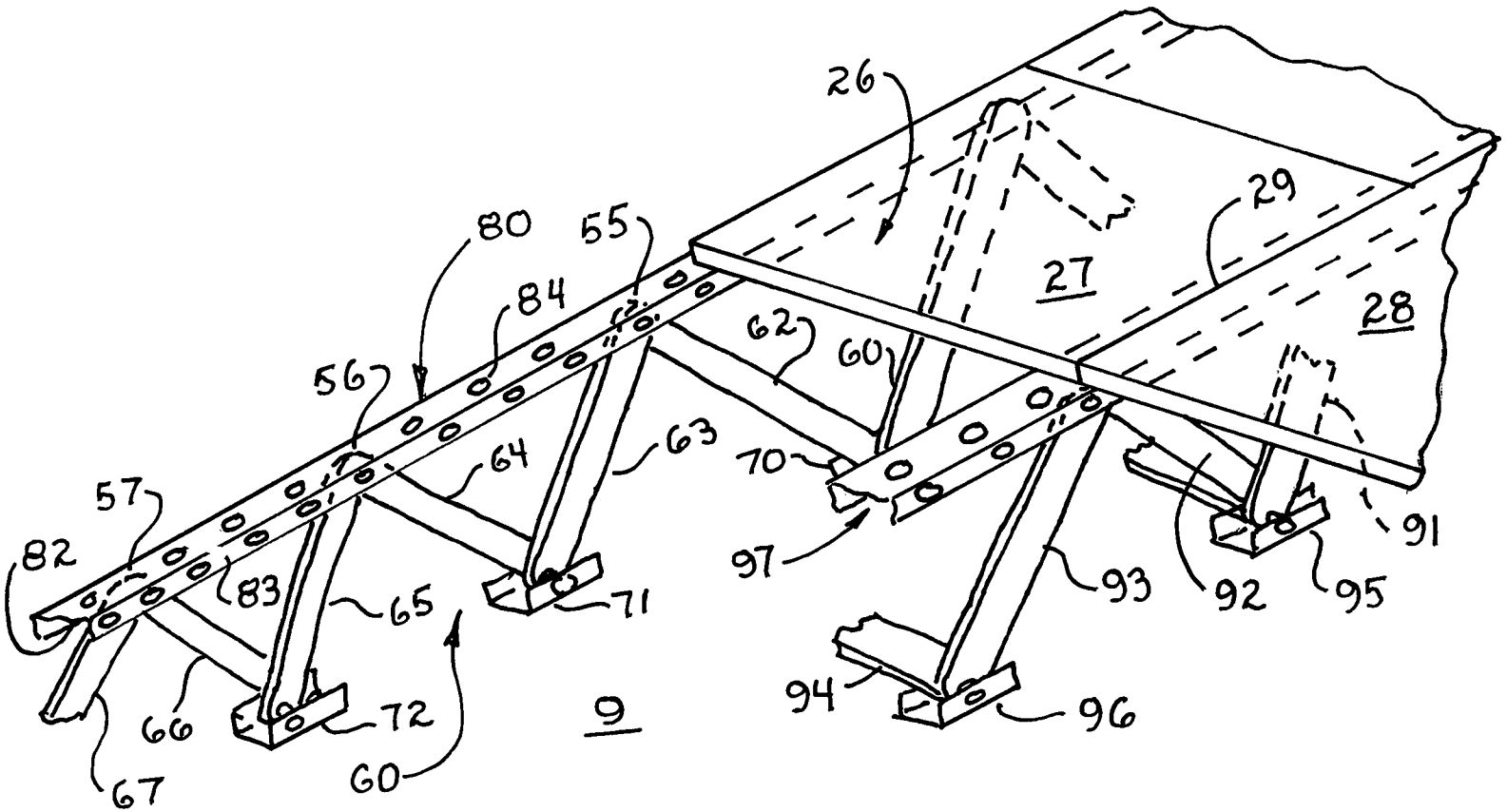
FIG. 4 sets forth a partial perspective assembly view of the upper and lower plate segment support structure of the present invention.

FIG. 4 sets forth a partial section perspective view of lower plate 26 together with a portion of the truss support utilized in supporting lower plate 26. By way of overview and returning to FIG. 1, it will be noted that in the side elevation view shown in FIG. 1, lower plate 26 is supported in an angular orientation by a plurality of support trusses generally referenced by numeral 2 which are joined by a corresponding plurality of truss hinges generally referenced by numeral 3. With continued reference to FIG. 1, it will also be noted that the truss support system supporting lower plate 26 utilizes a plurality of support trusses which are varied in size to provide the required support for lower plate 26. Once again as is seen in FIG. 1, support trusses vary in size from a minimum at the forward end or lowest portion of lower plate 26 to a maximum size at the forward end of lower plate 26 proximate to hinge 13 and deceleration chamber 5.

By way of overview, in the preferred fabrication of the present invention, lower plate 26 is supported by a spaced apart plurality of support truss assemblies each joined by a plurality of hinges. The support truss assemblies are arranged in parallel, front-to-back, arrangement as illustrated in FIG. 4 forming a spaced apart relationship. A plurality of channel struts, such as channel strut 40 shown in FIG. 5 and described below in greater detail, extend beneath lower plate 26. Each of the channel struts is secured to the upper truss hinges and thus rests one of the support truss assemblies.

Returning to FIG. 4, the partial perspective view set forth therein shows a pair of support truss assemblies generally referenced by numeral 60 and 90 are shown in the above-mentioned parallel arrangement. It will be understood that FIG. 4 sets forth a portion of the underlying truss support structure which is utilized to support lower plate 26. However, it will be equally well recognized that the support for lower plate 26 is provided by a plurality of parallel arranged truss support assemblies each generally configured to provide the angled support structure shown in FIG. 1.

More specifically, FIG. 4 sets forth a support truss assembly 60 fabricated of a plurality of support trusses such as trusses 61, 62, 63, 64, 65, 66 and 67. Once again it will be recognized that FIG. 4 sets forth a portion of support truss assembly 60. In further accordance with the present invention, support trusses 61 through 67 are shown joined at a plurality of truss hinge anchors such as anchors 70, 71 and 72. Truss anchors 70, 71 and 72 illustrate the provision of truss hinges generally referenced by numeral 3 and set forth above in FIG. 1 as secured to foundation floor 9 upon which the entire supporting truss structure shown in FIG. 4 is resting. In similar fashion to the support truss assembly set forth above in FIG. 1, support truss assembly 60 includes a plurality of truss hinge attachments such as truss hinge attachments 55, 56 and 57 shown in FIG. 4. In further accordance with the truss support structure described above, support truss assembly 60 includes an elongated channel strut generally referenced by numeral 80. Channel strut 80 extends front to back for the entire length of support truss 60 and, in accordance with the fabrication shown below in FIG. 5, forms a channel strut defining a center channel having an open bottom side, a top surface and a pair of downwardly extending side surfaces. Thus channel strut 80 includes a top surface 81 and downwardly extending side surfaces 82 and 83. Top surface 81 defines a plurality of apertures 84 while side surface 82 defines a plurality of apertures 85 while side surface 83 defines a plurality of apertures 86.

The supporting truss assembly shown in FIG. 4 further includes a support truss assembly generally referenced by numeral 90 which, as mentioned above, is positioned in a parallel arrangement to support truss 60. It will be understood that support truss assembly 90 is substantially identical to support truss assembly 60. It will be further understood that in the complete fabrication of the truss support apparatus which supports lower plate 26, a plurality of support truss assemblies all substantially identical to support truss assembly 60 are utilized. Thus, support truss assembly 90 includes a plurality of floor anchors 95 and 96 to which a plurality of trusses 91, 92, 93 and 94 are shown secured. In similar accordance to support truss assembly 60, support truss assembly 90 includes an elongated channel strut 97 which is substantially identical in fabrication to channel strut 80. In further accordance with the fabrication shown for support truss 60, struts 91, 92, 93 and 94 are joined at respective pivotal hinge joints to channel strut 97.

In the fabrication of the truss support apparatus for lower plate 26, a plurality of plate segments such as plate segments 27 and 28 are then placed upon the parallel arrangement of channel struts illustrated by channel struts 80 and 97. It will be noted that plate segments 27 and 28 abut along a seam 29. In the preferred fabrication of the present invention, the abutting end portions of plate segments 27 and 28 are mutually welded together and each also is welded to channel strut 97. The attachment welding for plate segments 27 and 28 is facilitated by the apertures in the top surface of channel strut 80. Thus, it will be apparent that the plate segments such as plate segments 27 and 28 are joined to their respective supporting channel struts by a welding operation performed from underneath the plates utilizing the apertures formed in the channel strut top surfaces. It will be further noted that the hinged attachment of the upper ends of supporting trusses are joined to their respective channel struts by utilizing a pin or plug inserted through the apertures formed in the side surfaces of the channel struts.

Figure 5:
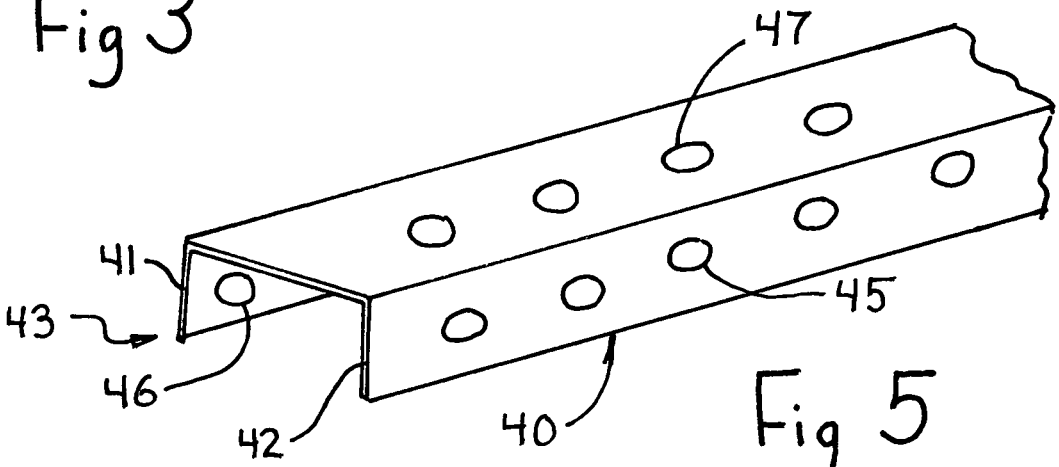
FIG. 5 sets forth a partial perspective view of a channel strut of the present invention.

FIG. 5 sets forth a perspective view of a portion of an illustrative channel strut generally referenced by numeral 40. Channel strut 40 is formed of a high strength material such as steel or the like. Channel strut 40 includes a top surface 44 and a pair of spaced apart downwardly extending side portions 41 and 42. The combination of top surface 44 and side surfaces 41 and 42 together with the open bottom side of channel strut 40 defines a downwardly open channel 43 extending the entire length of channel strut 40. Top surface 44 defines a plurality of apertures 47 while side surface 41 defines a similar plurality of apertures 46 and side surface 42 defines a plurality of apertures 45. Apertures 47 are utilized in the welding attachment of plate segments which are secured upon channel struts in the operation described above to support the plate segments of lower plate 26. Apertures 45 and 46 in side surfaces 42 and 41 respectively are provided in order to insert the junction dowels or plugs described above which provide the hinged attachment of the upper ends of the truss members.

Figure 6:
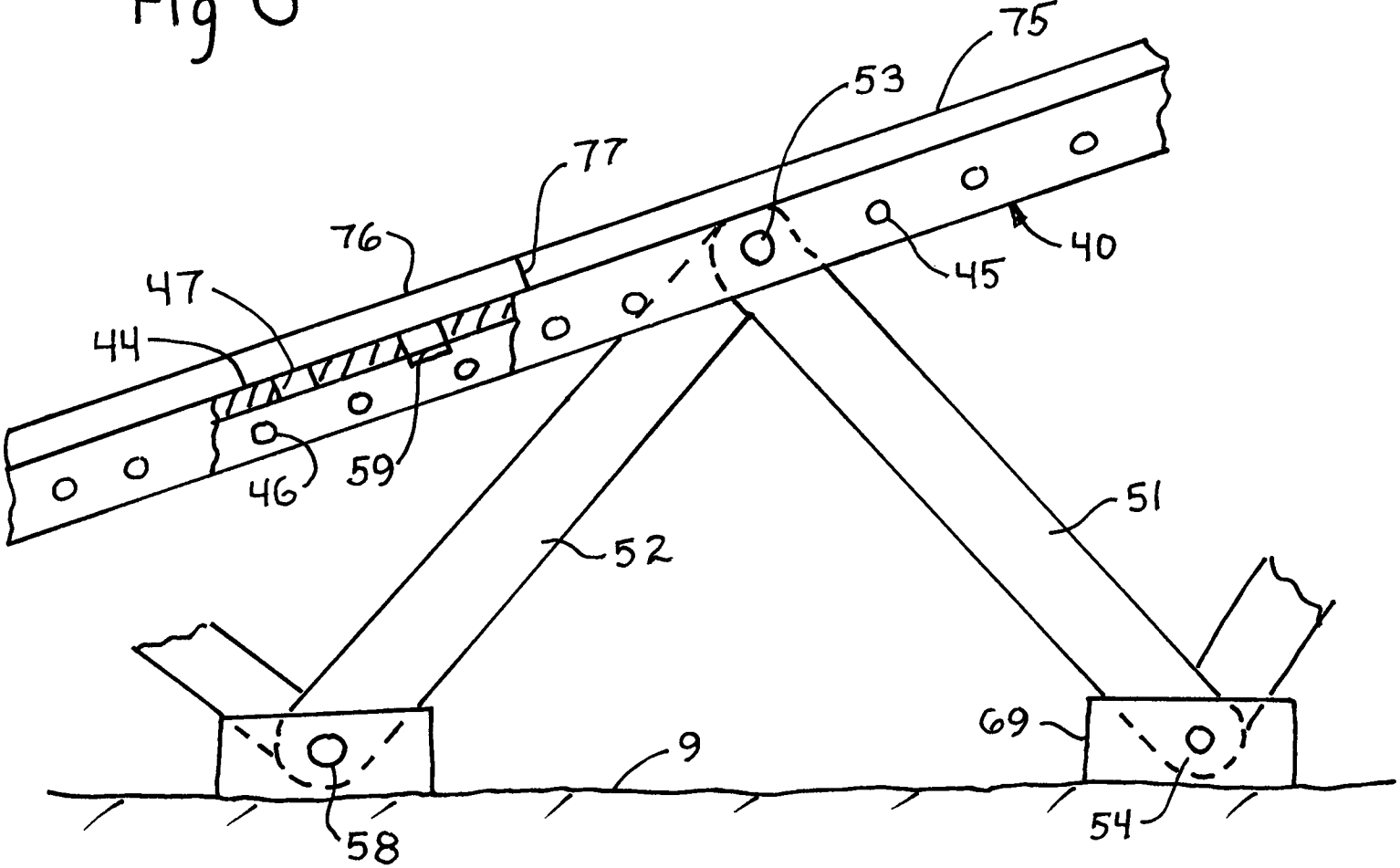
FIG. 6 sets forth a partial perspective view of the present invention lower plate segment support structure.

FIG. 6 sets forth a partial section side elevation view illustrating a typical plate attachment for a pair of plate segments which are arranged in an edge abutting fashion.

More specifically, a portion of a support truss assembly having a trusses 51 and 52 supports a channel strut 40 upon a foundation floor 9. The lower end of truss 51 is pivotally joined to a floor anchor 69 utilizing a pivot pin 54. Similarly, a truss 52 includes a lower end pivotally joined to support foundation 9 utilizing a pivot pin 58 within a floor anchor 68. The upper ends of trusses 51 and 52 meet to form a truss hinge within channel strut 40 and are secured in a pivotal attachment to channel strut 40 utilizing a pivot pin 53. It will be noted that pivot pin 53 passes through one of apertures 45 on one side of strut 40 and through one of apertures 46 on the remaining side of channel strut 40.

A pair of plate segments 75 and 76 are positioned upon top surface 44 of channel strut 40 and are arranged to form an edge abutting junction 77. In accordance with the preferred fabrication of the invention, the abutting edges of plate segments 75 and 76 are joined by a conventional weld junction (not shown). This provides a continuous smooth contour for the exposed surface of plate segments 75 and 76. FIG. 6 also illustrates alternative attachment mechanisms which may be utilized to secure plate segments 75 and 76 to top surface 44 of channel strut 40. As described above, top surface 44 of channel strut 40 defines a plurality of apertures 47 which may be utilized to join plate segment 76 to top surface 44 by welding through aperture 47 from beneath the structure. Alternatively, plate 76 may be provided with a plurality of weld plugs 59 which are secured to the underside of plate segment 76 and which extend through aperture 47 of top surface 44. Thereafter, conventional welding of plug 59 to top surface 44 of channel strut 40 may be utilized.

Figure 7:
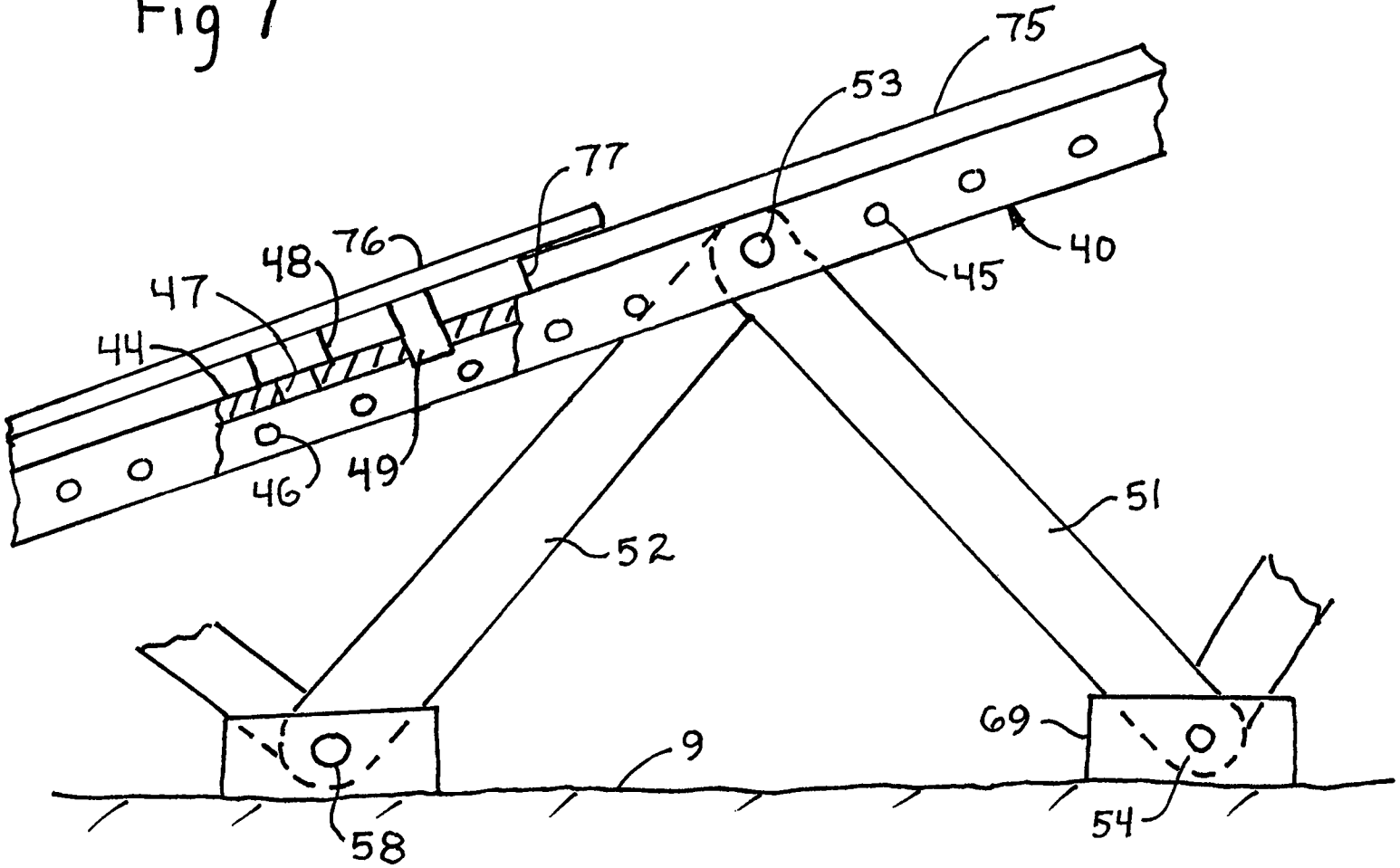
FIG. 7 sets forth a partial perspective view of an alternate embodiment of the present invention lower plate segment support structure.

FIG. 7 sets forth a partial section view of an alternate embodiment of the present invention. The embodiment shown in FIG. 7 differs from the embodiment shown in FIG. 6 in that it illustrates the attachment of plate segments which are not in an abutting relationship but rather overlap in the manner set forth above in FIG. 3. In all other respects, the structure shown in FIG. 7 is substantially identical to FIG. 6.

More specifically, a portion of a support truss assembly having a trusses 51 and 52 supports a channel strut 40 upon a foundation floor 9. The lower end of truss 51 is pivotally joined to a floor anchor 69 utilizing a pivot pin 54. Similarly, a truss 52 includes a lower end pivotally joined to support foundation 9 utilizing a pivot pin 58 within a floor anchor 68. The upper ends of trusses 51 and 52 meet to form a truss hinge within channel strut 40 and are secured in a pivotal attachment to channel strut 40 utilizing a pivot pin 53. It will be noted that pivot pin 53 passes through one of apertures 45 on one side of strut 40 and through one of apertures 46 on the remaining side of channel strut 40.

As can be seen in FIG. 7, the utilization of an overlapping joint between plate segments 75 and 76 prevents plate segments 75 and 76 from lying flat upon top surface 44 of channel strut 40 as occurs in the abutting junction utilized in FIG. 6. The overlap between plate segments 75 and 76 shown as overlapping joint 78 creates a space between top surface 44 of channel strut 40 and the underside of plate segment 76. Thus, the use of weld plug 49 may still apply so long as weld plug 49 is of sufficient length to pass through one of apertures 47 in top surface 44. Direct welding through aperture 47, however, requires that a spacer 48 having an aperture formed therein much like a conventional washer must be inserted between top surface 44 and underside of plate segment 76. Once spacer 48 has been aligned properly welding attachment between the underside of plate segment 76, the interior of spacer 48 and top surface 44 in the region of aperture 47 provides a secure attachment for plate segment 76.

Figure 8:
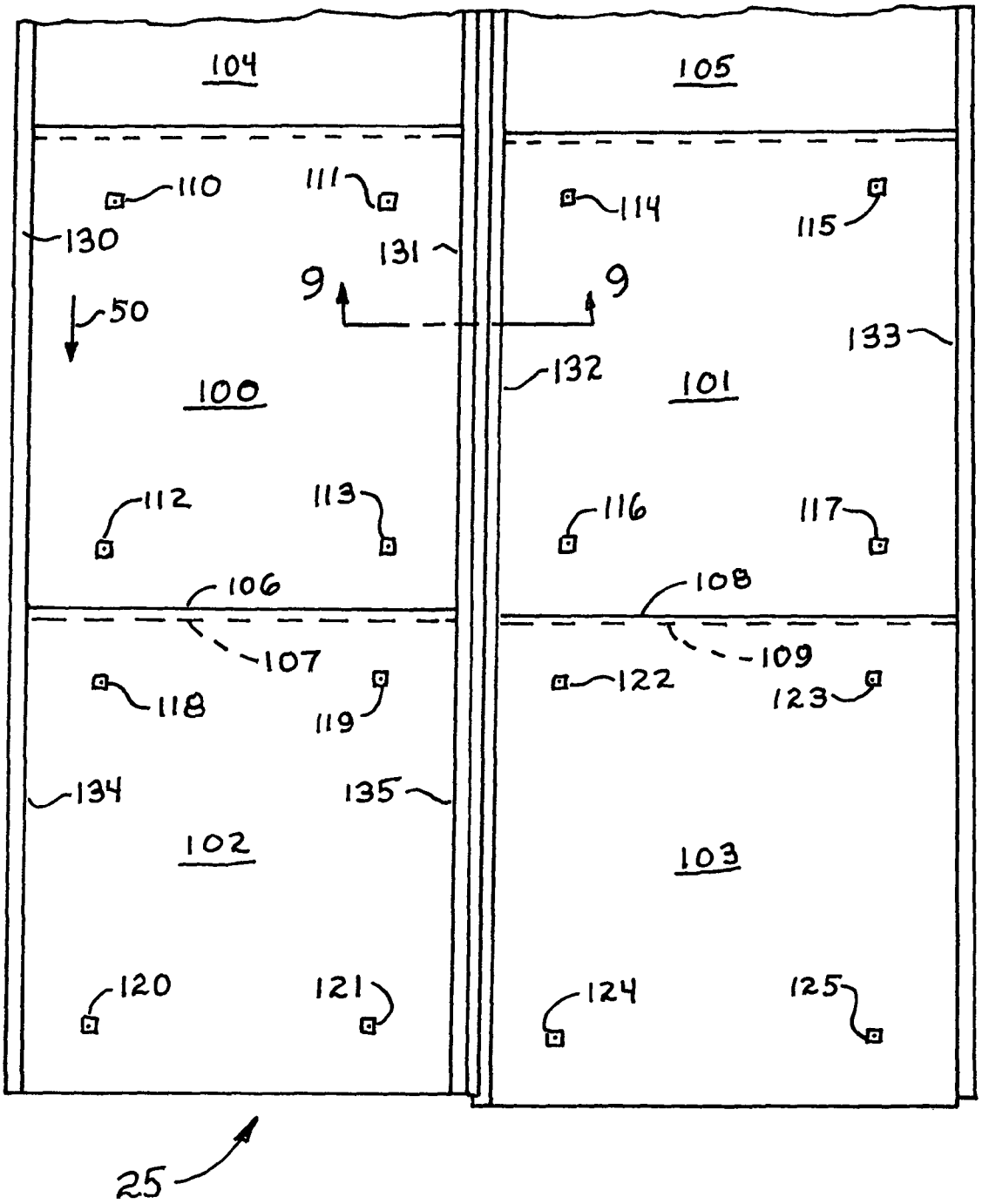
FIG. 8 sets forth a partial top view of the upper plate of the present invention.

FIG. 8 sets forth a top view of a portion of upper plate 25 setting forth the structural details by which a plurality of plate segments are joined to form upper plate 25 which is suspended in the manner set forth above in FIG. 1 to provide an angled upper plate. In the preferred fabrication of the present invention, upper plate 25 is fabricated of a plurality of plate segments which are supported and joined to form a substantially continuous upper plate. FIG. 8 sets forth a plurality of such plate segments 100 through 103 which are set forth to illustrate the side edge to side edge attachment of such plate segments and to illustrate an overlapping joint embodiment of the present invention joining plate segments in a front edge to rear edge overlap. With temporary return to FIG. 3, it will be noted that the direction of plate segment overlap is preferably oriented to avoid presenting a front exposed edge to projectiles and bullets passing between and possibly impacting upper plate 25 and lower plate 26. In further 3, the direction of projectile and bullet travel is indicated by arrow 50. This nomenclature has been maintained in FIG. 8 showing arrow 50 indicating the direction of projectile and bullet travel.

Returning to FIG. 8, a plurality of plate segments 100 through 105 are shown in an arrangement which illustrates both front to back overlapping joints and side edge to side edge attachment between plate segments. Thus, more specifically, upper plate 25 includes a plate segment 100 having a plurality of suspension attachments 110 through 113 secured to the upper surface of plate segment 100 utilizing conventional welding attachment or other suitable attachment. Suspension attachments 110 through 113 provide means for securing the lower end of the suspension elements which hang plate segment 100 from the supporting ceiling in the manner shown in FIG. 1. It will be recognized that various suspension elements such as chains, cables, elongated rods or the like may be utilized to provide suspension of plate segment 100 from attachment to suspension attachments 110 through 113. Plate segment 100 also includes an elongated generally L-shaped cross-section angle iron 130 which is secured to the upper surface of plate segment 100 by conventional welding fabrication techniques. Plate segment 100 further includes a second angle iron 131 which is secured to the upper surface of plate segment 100 also by conventional welding techniques. Plate segment 100 further includes an edge 107 which is downstream of projectile and bullet travel. Similarly, upper plate 25 includes plate segment 101 having suspension attachments 114 through 117 and angle irons 132 and 133 welded thereto. By further similarity, upper plate 25 includes a plate segment 102 having suspension attachments 118 through 121 and angle irons 134 and 135 welded thereto. By further similarity, upper plate 25 includes a plate segment 103 having a plurality of suspension attachments 122 through 125 welded to the upper surface thereof together with a pair of angle irons 136 and 137 also welded to the upper surface of plate segment 103. A portion of plate segments 104 and 105 are shown in partial view to illustrate the continuing arrangement of plate segments which comprise upper plate 25.

Figure 9:
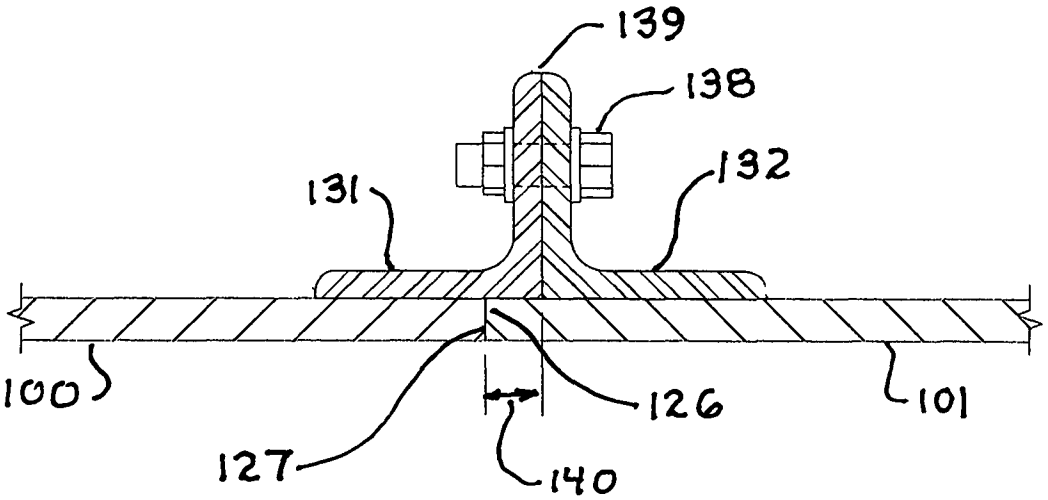
FIG. 9 sets forth a partial section view of an upper plate junction of the present invention taken along section lines 9-9 in FIG. 8.

Plate segments 100 and 101 are joined by the cooperation of angle irons 131 and 132 which, in accordance with the partial section view shown in FIG. 9, are joined using conventional threaded nut and bolt attachment. As is also seen in FIG. 9, the positioning of angle irons 131 and 132 is offset with respect to the abutting edges of plates 100 and 101 to provide a continuous secure attachment and contour. The structure of the junction between plate segments 100 and 101 along their respective side edges is shown in greater detail in FIG. 9. However, suffice it note here that the positioning of angle irons 131 and the use of conventional fasteners allows each of the plate segments within upper plate 25 to be joined along their side edges to form a row of plate segments. FIG. 8 also shows the overlapping type plate joint utilized between each of the plate segments within upper plate 25 which provides the overlapping joint illustrated in FIG. 3. It will be recalled that plate segments within upper plate 25 may also be joined in an abutting configuration at illustrated in FIG. 2 avoiding the necessity for an overlapping joint. Thus, with attention to the overlapping edge joint between plate segments 100 and 102, it will be noticed that edge 107 of plate segment 100 passes beneath edge 106 of plate segment 102. This is the appropriate orientation with respect to direction of projectile and bullet travel indicated by arrow 50. Similarly, plate segments 101 and 103 are joined to form an overlapping edge joint between edge 108 of plate segment 103 and edge 109 of plate segment 101. Thus utilizing a plurality of plate segments joined along their side edges by the edge attachment shown in FIG. 9 and forming rows of plate segments which are joined to other rows of plate segments utilizing the overlapping joint illustrated in FIG. 3, the entirety of upper plate 25 is formed. The angle presented by upper plate 25 is adjusted by adjusting the length of the supporting suspension elements which hang upper plate 25 from the supporting ceiling. As mentioned above, the suspension elements may include conventional chains, tables having length adjustment in accordance with conventional fabrication techniques as well as rigid rods having extension couplers also in accordance with conventional fabrication techniques. The essential function of such suspension elements is to allow the adjustment of the geometry presented by upper plate 25.

FIG. 9 sets forth a partial section view of the side edge to side edge junction between plate segments 100 and 101 taken along section lines 9-9 in FIG. 8. As described above, plate segment 100 supports an angle iron 131 joined to the upper surface of plate segment 100 by a conventional welding attachment. As is also described above, plate segment 101 supports an angle iron 132 which is similarly welded to the upper surface of plate segment 101. Plate segment 100 defines a side edge 126 while plate segment 101 defines a side edge 127. To provide a secure junction between plate segments 100 and 101, the positions of angle irons 131 and 132 are offset from the edge abutment of edges 126 and 127 of plate segments 100 and 101 by a distance indicated by reference numeral 140. Thus, as plate segments 100 and 101 are brought into edge abutment, angle irons 131 and 132 are also brought into abutment forming a seam 139. A conventional nut and bolt fastener 138 passes through apertures formed in angle irons 131 and 132 to secure the angle irons together. The use of the offset of angle irons 131 and 132 ensures a smooth contour at the junction of plate segments 100 and 101.

What has been shown is a plate-type bullet trap in which the geometry of the bullet trap presented to incoming bullets or other projectiles may be adjusted through individual adjustment of the upper and lower plates as well as a combined adjustment of both plates to change the angular orientation of the entire bullet trap.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A bullet trap for use in a target range within which a plurality of projectiles or bullets are fired or directed toward one or more targets, said bullet trap comprising:

a bullet receiving area for receiving bullets or projectiles;

an upper plate having a projectile and bullet impervious plate supported above the projectile or bullet line of flight, said upper plate being angled downwardly toward said bullet receiving area;

a lower plate support having a plurality of support truss assemblies arranged beneath said upper plate, said support truss assemblies each including a plurality of elongated trusses each having first and second truss ends, a plurality of upper truss hinges each joined to one of said first truss ends, a plurality of lower truss hinges each joined to one of said second truss ends and each secured to a floor surface, and an elongated channel joined to said upper truss hinges;

a lower plate supported beneath said upper plate and having a projectile and bullet impervious plate, said lower plate being supported in an upwardly angled orientation upon said elongated channels generally converging toward said bullet receiving area; and a projectile and bullet collecting apparatus including a deceleration chamber positioned within said bullet receiving area to receive projectiles or bullets passing into said bullet receiving area, said upper and lower plates being adjustably positioned to provide an optimized geometry for projectile or bullet collection.

2. The bullet trap set forth in claim 1 wherein said upper plate includes:

an upper plate suspension apparatus coupled to said upper plate supporting said upper plate; and upper plate angle adjustment apparatus for changing the angle of said upper plate.

3. The bullet trap set forth in claim 2 wherein said upper plate includes a plurality of upper plate segments joined to form said upper plate.

4. The bullet trap set forth in claim 3 wherein said lower plate includes a plurality of lower plate segments joined to form said lower plate.

5. The bullet trap set forth in claim 1 wherein said upper plate and said lower plate are joined to said deceleration chamber by hinged attachments.

6. The bullet trap set forth in claim 1 wherein said support truss assemblies are arranged in a parallel relationship.

7. A bullet trap for use in a target range within which a plurality of projectiles or bullets are fired or directed toward one or more targets, said bullet trap comprising:

a bullet receiving area for receiving bullets or projectiles;

an upper plate supported above the projectile or bullet line of flight, said upper plate being angled downwardly and forwardly toward said bullet receiving area thereby defining an upper plate angle;

a lower plate support having a plurality of support truss assemblies arranged beneath said upper plate, said support truss assemblies each including a plurality of elongated trusses each having first and second truss ends, a plurality of upper truss hinges each joined to one of said first truss ends, a plurality of lower truss hinges each joined to one of said second truss ends and each secured to a floor surface, and an elongated channel joined to said upper truss hinges;

a lower plate supported beneath said upper plate by said lower plate support, said lower plate being angled upwardly and forwardly converging toward said bullet receiving area thereby defining a lower plate angle; and a projectile and bullet collecting apparatus positioned within said bullet receiving area to receive projectiles or bullets passing into said bullet receiving area, said upper and lower plate angles being independently adjustable adjustably positioned to provide an optimized geometry for projectile or bullet collection.

* * * * *